United States Patent [19]

Hanna et al.

[11] Patent Number: 5,074,546

[45] Date of Patent: Dec. 24, 1991

[54] BI-DIRECTIONAL DOWN DRIVE ASSEMBLY FOR A DOCUMENT TRACK

[75] Inventors: Peter D. Hanna; Robert W. Phillips, both of Waterloo; William B. Montague, St. Jacobs; Fredrik L. N. Kallin, Waterloo, all of Canada

[73] Assignee: NCR Corporation, Dayton, Ohio

[21] Appl. No.: 633,693

[22] Filed: Dec. 20, 1990

[51] Int. Cl.[5] ..... B65H 9/16

[52] U.S. Cl. ..... 271/251; 271/250; 271/274; 271/314

[58] Field of Search ..... 271/248, 249, 250, 251, 271/253, 254, 272, 273, 274, 184, 314, 225, 266, 229

[56] References Cited

U.S. PATENT DOCUMENTS

| | | | |
|---|---|---|---|
| 4,506,878 | 3/1985 | Bashford | 271/227 |
| 4,557,473 | 12/1985 | Pecak | 271/229 |
| 4,630,815 | 12/1986 | Petersen et al. | 271/273 |
| 4,815,726 | 3/1989 | Pagowski et al. | 271/274 |

FOREIGN PATENT DOCUMENTS

| | | | |
|---|---|---|---|
| 2171395 | 8/1986 | United Kingdom | 271/251 |

*Primary Examiner*—H. Grant Skaggs
*Attorney, Agent, or Firm*—Elmer Wargo

[57] ABSTRACT

An apparatus for moving a document towards the bottom of a document track as the document is moved in first and second directions within the track. The apparatus includes a feed unit positioned on one side of the document track and a cooperating unit positioned on the opposed side of the track. The cooperating unit has a rod which is pivotally supported in a support. A high friction roller is secured to the top end of the rod and a low friction roller is rotatably supported on the lower end of the rod. The feed unit has an idler roller positioned opposite to the high friction roller and also has a drive roller positioned opposite to the low friction roller in the cooperating unit. As the document is moved in a first direction in the document track, the high friction roller causes the rod to pivot slightly, thereby causing the low friction roller on the bottom of the rod to cant slightly, producing a downward component of force on the document as it is moved in the first direction. When the document is moved in the opposite direction, the low friction roller is canted slightly in the opposite direction to produce a downward component of force on the document as it is moved in the second direction.

17 Claims, 3 Drawing Sheets

BI-DIRECTIONAL DOWN DRIVE ASSEMBLY FOR A DOCUMENT TRACK

BACKGROUND OF THE INVENTION (1) Field of the Invention

This invention relates to an apparatus for maintaining the bottom of a document in contact with the bottom of a document track while the document is fed bi-directionally within the track.

(2) Background Information

In certain document processing machines, like encoders and sorters, for processing documents, like checks and deposit slips, it is important to have the bottom of the document in contact with the bottom of a document track associated with the machine. Keeping the bottom of the document in contact with the bottom of the document track provides the registration necessary to have the document in registration with or aligned with certain document processing elements positioned along the length of the track in operative relationship therewith. Typical document processing elements are MICR readers and encoders or printers, for example.

Even though a document is positioned, initially, in proper registration with the document track (with the bottom length of the document in parallel contact with the bottom of the track), the document tends to become misaligned as it is moved in the track in operative relationship with the document processing elements positioned along the length of the track. This problem is solved in machines having unidirectional document transports by having the associated drive and/or idler rollers set at a fixed angle so as to provide a slight downward component of movement towards the bottom of the track as the document is moved along the length of the track.

The technique mentioned in the previous paragraph is not suitable when a bi-directional transport is used in the document processing machine. This is because the drive and/or idler rollers were set at a fixed angle to provide a downward component when the document is moved in only one direction. When the document is moved in the opposite direction in the document track, the drive and/or idler rollers raise the document away from the bottom of the document track. Providing a high-precision, parallel drive transport does not seem to work well at all times because "tolerance build-up" and dirt, for example, may result in unpredictable document skew.

SUMMARY OF THE INVENTION

An object of this invention is to provide an apparatus which provides a slight downward drive on a document being moved bi-directionally in a document track so as to maintain the bottom of the document in registration with the bottom of the document track.

A preferred embodiment of this invention relates to an apparatus comprising:

- a track having first and second side walls and a bottom;
- a feed unit for moving a document in first and second directions in said track; and
- a cooperating unit cooperating with said feed unit to move said document in said first direction and towards said bottom when said feed unit is rotated in a first direction, and also to move said document in said second direction and towards said bottom when said feed unit is rotated in a second direction.

The present invention is easy to incorporate in existing document feed mechanisms, and is inexpensive to manufacture.

The above advantages and others will be more readily understood in connection with the following description, claims, and drawing.

DETAILED DESCRIPTION OF PREFERRED EMBODIMENTS OF THIS INVENTION

Figure 1:
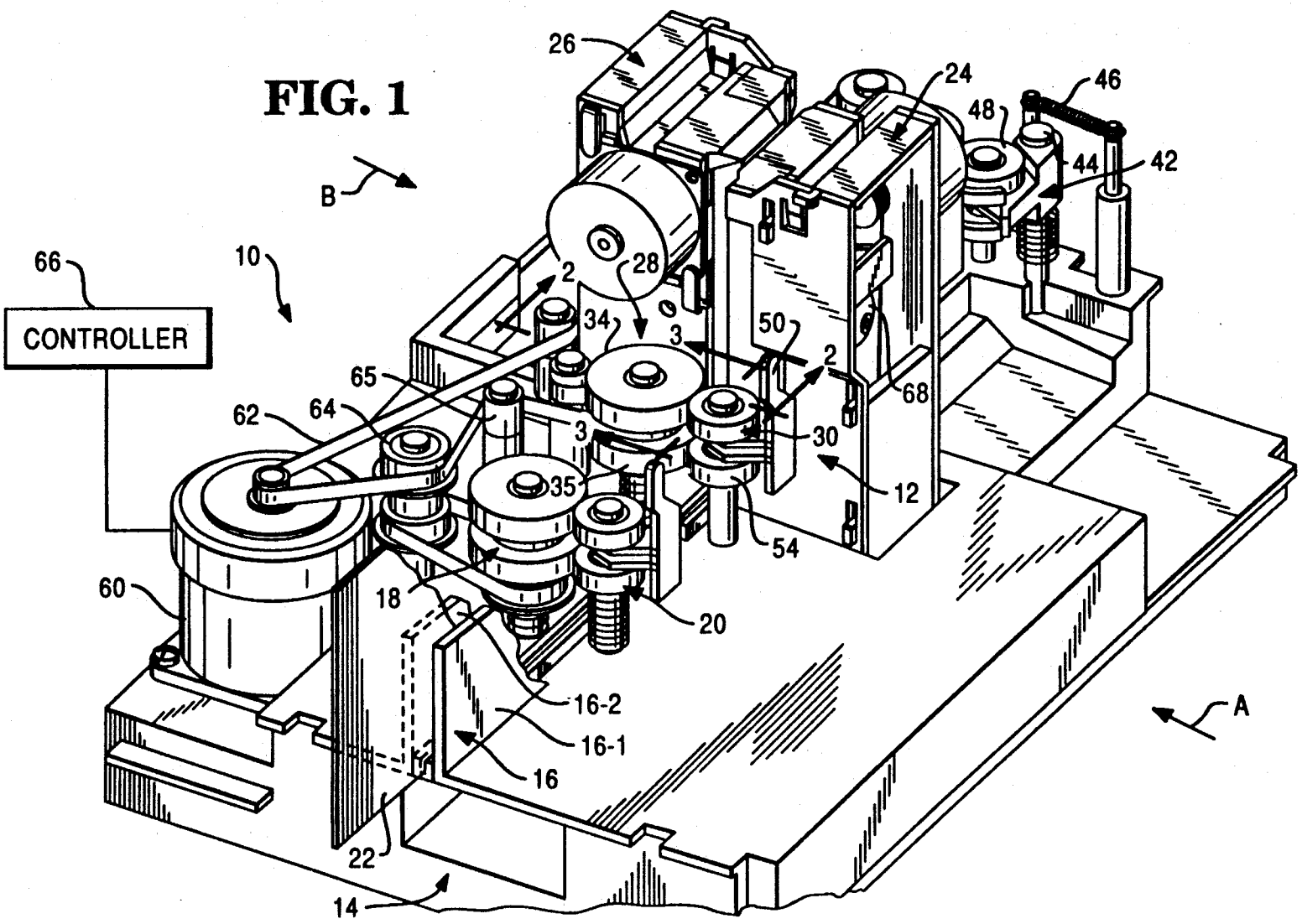
FIG. 1 is a general, schematic view of a document processing machine in which a preferred embodiment of this invention may be used, with the view showing a document track, document processing elements positioned along the document track, and the apparatus of this invention; certain portions of the machine are broken away or removed to facilitate a showing of the apparatus of this invention.

FIG. 1 is a general isometric view of a document processing machine (designated generally as machine 10) in which an apparatus 12 made according to this invention may be used. The machine 10 has a frame or chassis 14 with a document track 16 mounted thereon. The document track 16 has first and second side walls 16-1 and 16-2 upstanding from the chassis 14 and also has a track bottom 16-3, shown schematically in FIG. 2.

The machine 10 has feed members or pairs of drive rollers (designated generally as 18 in FIG. 1) positioned along the length of the track 16 to cooperate with pairs of idler rollers 20 to move a document 22 in the track in operative relationship with processing elements which are positioned along the length of the track. The processing elements may include, for example, text and graphics printers (designated generally as printers 24 and 26). Additional and different processing elements (not shown) may also be positioned along the track 16 to further process the document 22.

Figure 2:
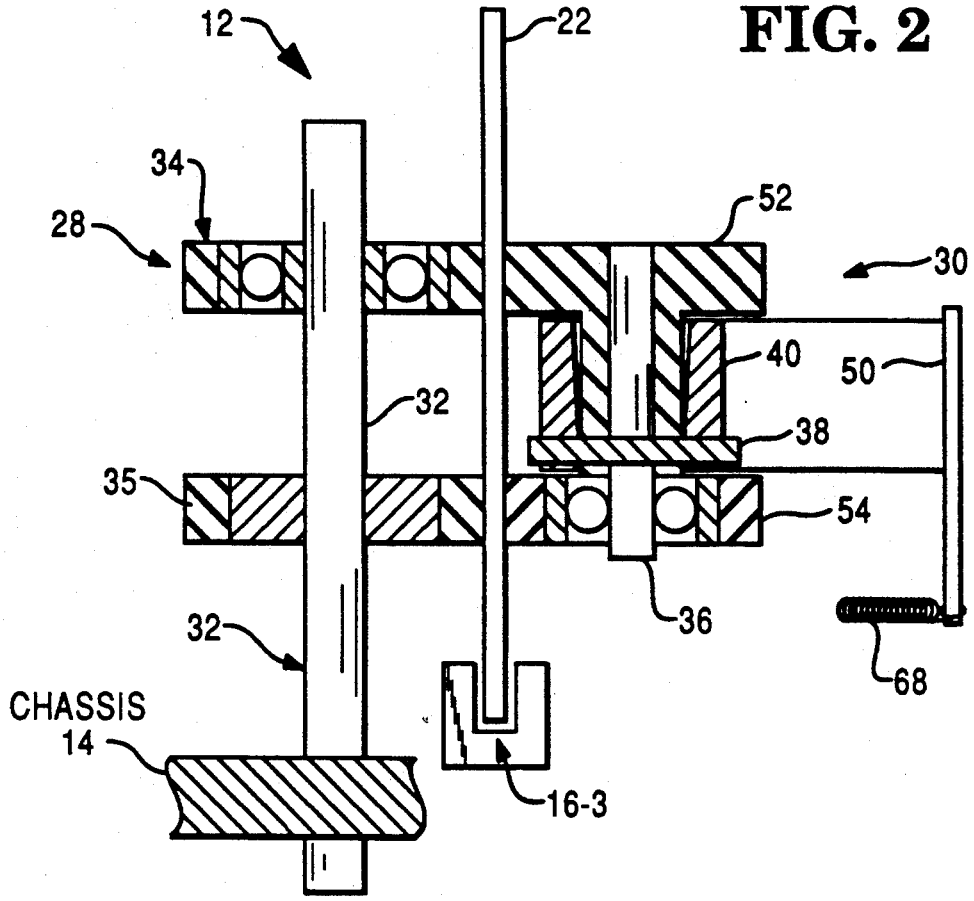
FIG. 2 is a schematic diagram, in cross section, of the apparatus shown in FIG. 1 and is taken along the general line 2—2 shown in FIG. 1 to show a feed unit and a cooperating unit included in the apparatus.

The apparatus 12 includes a feed unit 28 and a cooperating unit 30 which cooperates with the feed unit 28 to drive the document 22 therebetween as shown best in FIG. 2. The feed unit includes a drive shaft 32 having a roller 34 rotatably mounted thereon, and it also includes a feed roller or drive roller 35 fixed to the drive shaft 32 to rotate therewith. The drive shaft 32 is rotatably mounted in the chassis 14 and is driven or rotated bi-directionally as will be described hereinafter.

The cooperating unit 30 includes a support member or rod 36 which is pivotably mounted between its ends on a pin 38 (FIG. 3) which passes through a collar type support 40. The support 40 may be part of an arm assembly (like 42, shown in FIG. 1) which is rotatably supported on a rod 44 which is upstanding from the chassis 14. The arm assembly 42 is resiliently biased to rotate in a clockwise direction, as viewed in FIG. 1, by a tension spring 46 on the arm 42 so as to bias the arm assembly 42 (which contains the usual pinch rollers 48) into engagement with the associated drive rollers (not shown in FIG. 1 but they are like the pair of drive rollers 18). The arm assembly 42 is not important to an understanding of this invention; however, it is discussed to show how the support 40 may be mounted for supporting the rod 36. The arm assembly 42 may be rotated about the rod 44 in a counterclockwise direction as viewed in FIG. 1 so as to move the pinch rollers 48 away from the document track 16 to enable a jammed document 22 to be removed therefrom. An arm assembly 50, having the support 40 secured thereto, is used, similarly, to move the cooperating unit 30 away from the document track 16.

Continuing with the discussion of the cooperating unit 30, the pin 38 (FIG. 3) is located in the support 40 so that the rod 36 pivots only in a plane which is parallel to the document track 16. The first or upper end of the rod 36 has a first member 52 fixed thereto, and the second or lower end has an idler roller 54 rotatably mounted thereon. The support 40 is generally cylindrical in shape externally, and it has an internal shape which is generally conical. By this design, the rod 36 is limited in its pivoting to a predetermined arc of about 2 degrees on each side of a vertical centerline 56 which is perpendicular to the track bottom 16-3. The internal conical wall 58 of the support 40 performs the limiting mentioned.

In the embodiment described, the idler roller 34 (FIG. 2) of the feed unit 28 is considered a low friction drive with very little friction provided by its periphery. The drive roller 35 of the feed unit 28 is considered a high friction drive with its periphery providing a high friction to move the document 22. The first member 52 of the cooperating unit 30 is arcuately shaped or has the shape of a roller and provides a high friction surface when a document 22 is positioned between it and the roller 34. The second member or idler roller 54 of the cooperating unit 30 provides a low friction surface to the document 22 positioned between it and the drive roller 35 of the feed unit 28.

The pair of drive rollers 18 (FIG. 1) and the drive shaft 32 are rotated in the same direction by a bi-directional stepper motor 60 and conventional driving elements including a timing belt 62 and suitable idler rollers 64 and 65, for example, which are not important to an understanding of this invention. The stepper motor 60 is controlled by a controller 66 to provide the bi-directional control necessary to move the document 22 bi-directionally within the document track 16 in operative relationship with the printers 24 and 26, for example. The printers 24 and 26 each may have a print head 68 therein which is moved up and down relative to the document track 16. When the document 22 is moved bi-directionally within the document track 16 while the print head 68 is moved up and down when necessary, the printing of text and graphics may be effected.

The apparatus 12 works as follows. When the document 22 is to be moved to the right, as viewed in FIG. 3, the drive roller 35 is rotated in a counterclockwise direction as viewed in FIG. 1. As the document 22 moves to the right (FIG. 3) between the drive roller 35 of the feed unit 28 and the idler roller 54 of the cooperating unit 30, the first member 52 (high friction) of the cooperating unit 30 (opposite to the roller 34 of the feed unit 28) will cause the rod 36 to pivot about the pin 38 in a clockwise direction (as viewed in FIG. 3). When so pivoting, the idler roller 54 (low friction) will be canted slightly from the position shown in FIG. 3 to provide a downward component of force which moves the document 22 towards the track bottom 16-3 while the document 22 is moved to the right. When the document 22 is to be moved to the left as viewed in FIG. 3, the rod 36 will pivot in a counterclockwise direction from the position shown to cause the idler roller 54 to be canted, slightly, to provide a downward component of force which moves the document 22 towards the track bottom 16-3 as the document 22 is moved to the left in the document track 16-3. Thus, the feed unit 28 of the apparatus 12 is tiltable and functions as a toggle mechanism to move the document 22 towards the track bottom 16-3 regardless of the direction in which the document 22 is fed in the document track 16.

The first member 52 may be made of a tough wearing plastic material like Delrin. Even though the first member 52 may wear slightly with the passage of time, any slight flattening of the periphery of the first member 52 is inconsequential because the cooperating unit 30 is resiliently biased towards the feed unit 28 by a spring 68 (FIG. 3) as discussed in relation to the arm assembly 42.

Figure 4:
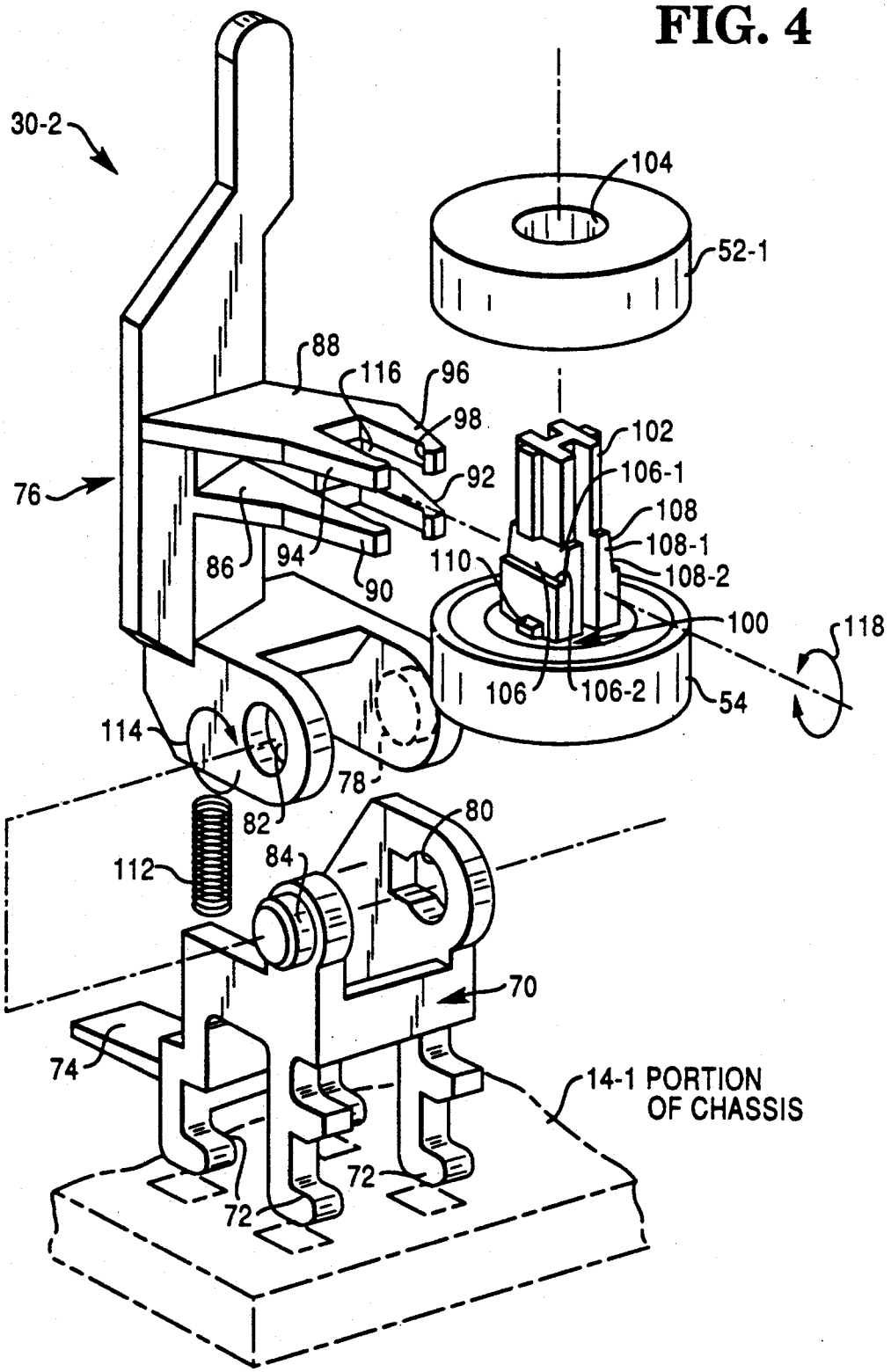
FIG. 4 is an exploded, isometric view of a second embodiment of the cooperating unit which cooperates with the drive unit shown in FIG. 1, with the view taken from the general direction of arrow B shown in FIG. 1.

FIG. 4 shows a second embodiment of the cooperating unit which is designated generally as 30-2 and which functions in the same general manner as does cooperating unit 30; however, its construction is somewhat different. In this regard, the cooperating unit 30-2 has a base 70 which has legs 72 depending therefrom to pass through mating holes in a portion 14-1 of the chassis 14. An operating lever 74 is used to secure the base 70 in the appropriate position next to the document track 16; because this aspect is not important to an understanding of this invention, it need not be discussed in any more detail.

Figure 3:
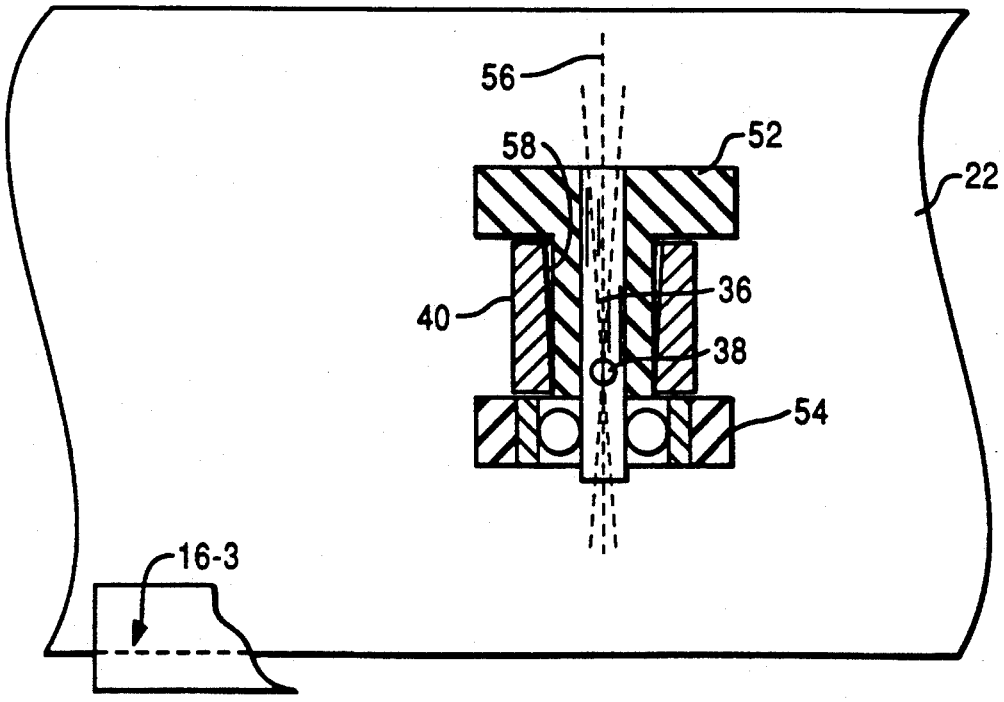
FIG. 3 is a schematic diagram, in cross section, of the cooperating unit shown in FIG. 2 and is taken along the general line 3—3 of FIG. 1.

The cooperating unit 30-2 (FIG. 4) also has a support frame 76 which supports a first member 52-1 and an idler roller 54 which is similar to that shown in FIGS. 2 and 3. The support frame 76 is pivotally supported on the base 70 by having a short rod 78 (shown in dashed outline) which fits into a mating opening 80 in the base 70 and also by having an opening 82 in the support frame 76 which mates with a short rod 84 extending from the base 70. The support frame 76 and the base 70 are made of a tough plastic material which can be flexed somewhat, if necessary, to effect the mounting described.

The support frame 76 has first and second spaced, parallel extensions 86 and 88 which extend from the support frame 76 as shown in FIG. 4. The first extension 86 has fingers 90 and 92 extending therefrom, and similarly, the second extension 88 has fingers 94 and 96 extending therefrom. Each of the fingers 90, 92, 94, and 96 has a projection, like 98 on finger 96, which extends towards the opposed finger, like 94, to provide a narrow entrance to the spaces between these fingers to retain a support member or pivot shaft 100.

The pivot shaft 100 (FIG. 4) is made of plastic material, and it has an "H" configuration 102 on the top end thereof which is press fitted into the central opening 104 of the member 52-1 to secure the member 52-1 on the pivot shaft 100. The pivot shaft 100 has flat areas 106 and 108 on opposed sides sides thereof, with these sides being almost parallel to each other except for the fact that the top portions, like 106-1 and 108-1, are closer to each other than the associated bottom portions. The bottom end of the pivot shaft 100 has the second roller 54 rotatably mounted thereon.

The pivot shaft 100 is mounted on the support frame 76 by pushing the flat areas 106 and 108 of the pivot shaft 100 between the fingers 94 and 96 and between the fingers 90 and 92, with these fingers flexing, slightly, to receive the pivot shaft 100 therebetween. The pivot shaft 100 is restrained from moving in a vertical direction by the "H" configuration 102 and a shoulder 110 on each side of the pivot shaft 100. The distance between the fingers 90 and 92 and between the fingers 94 and 96 is the same; consequently, because the distance between the top portions 106-1 and 108-1 is less than the distance between the bottom portions 106-2 and 108-2 of the flat areas 106 and 108, the top portion of the pivot shaft 100 with the first member 52-1 thereon will pivot in the same manner as the first member 52 shown in FIG. 3. The distance between the fingers 90 and 92 is slightly greater than the distance between the bottom portions 106-2 and 108-2.

The cooperating unit 30-2 has a compression spring 112 (shown schematically in FIG. 4) which is positioned between the portion 14-1 of the chassis 14 and the underside of the support frame 76 to pivot the support frame 76 on the short rods 84 and 78 in the direction of arrow 114. When so pivoting, the support frame 76 resiliently biases the first member 52-1 into engagement with the first roller 34 shown in FIG. 1, and resiliently biases the second roller 54 into engagement with the drive roller 35 of the feed unit 28. There is some looseness between the rods 84 and 78 and their associated openings 82 and 80 to enable the member 52-1 and the second roller 54 of the cooperating unit 30-2 to contact the associated rollers 34 and 35 in the feed unit 12. The support frame 76 also has a convex area 116 which abuts against the pivot shaft 100 and also enables the pivot shaft 100 to pivot slightly towards and away from feed unit 12 (FIG. 2) to enable the member 52-1 and the second roller 54 to contact the associated rollers 34 and 35 of the feed unit 12. The pivot shaft 100 pivots about 2 degrees in opposed directions as shown by double arrow 118 for the same purposes discussed in relation to FIG. 3. The materials selected for the member 52-1 and the second roller 54 are the same materials as those used in their counterparts in the feed unit 12 shown in FIG. 2. The support frame 76 may be pivoted in a direction opposite to the direction of arrow 114 to move the cooperating unit 30-2 away from the associated feed unit 12 to clear a document 22 jammed therebetween.

What is claimed is:

1. An apparatus comprising:

a track having first and second side walls and a bottom;

a first roller rotatably mounted on a shaft adjacent to said track and a second roller fixed to said shaft to rotate therewith;

a support and a support member pivotally mounted in said support, said support member having first and second ends;

a first member fixed to said first end of said support member to engage said first roller;

a second member rotatably mounted on the second end of said support member to engage said second roller; and resilient means urging said first and second members against said first and second rollers;

said second member cooperating with said second roller to move a document therebetween in a first direction in said track and towards said bottom when said second roller is rotated in a first direction, and to move said document in a second direction and towards said bottom when said second roller is rotated in a second direction.

2. The apparatus as claimed in claim 1 in which said support is shaped to limit an arc through which said support member may pivot.

3. The apparatus as claimed in claim 2 in which said first roller has a periphery having low friction, and said second roller has a periphery having high friction.

4. The apparatus as claimed in claim 3 in which said support member pivots only in a plane parallel to said first and second side walls.

5. The apparatus claimed in claim 4 in which said first member has a periphery of high friction, and said second member is a roller bearing having a periphery of low friction.

6. The apparatus as claimed in claim 1 in which said support comprises:

a base;

a support frame pivotally mounted on said base; and first and second extensions extending from said support frame;

said support member being pivotally mounted on said first and second extensions.

7. The apparatus as claimed in claim 7 in which each of said first and second extensions has first and second spaced apart fingers extending therefrom, and in which said support member has first and second flat areas positioned between said first and second spaced apart fingers associated with said first and second extensions to enable said support member to pivot relative to said first and second extensions.

8. The apparatus as claimed in claim 7 in which said first and second flat areas are closer together near said first and second spaced apart fingers of said first extension than near said said first and second fingers of said second extension.

9. The apparatus as claimed in claim 8 in which said support frame has a convex area located between said first and second extensions to facilitate maintaining said first and second members in engagement with said first and second rollers.

10. The apparatus as claimed in claim 9 in which said first roller has a periphery having low friction, and said second roller has a periphery having high friction.

11. The apparatus as claimed in claim 10 in which said first member has a periphery of high friction, and said second member is a roller bearing having a periphery of low friction.

12. A toggle mechanism for use with first and second rollers, with said first roller being rotatably mounted on a shaft positioned adjacent to a track having a bottom, and with said second roller being fixed to said shaft to rotate therewith; said toggle mechanism comprising:

a support arm;

a support member having first and second ends, with said support member being pivotally mounted between said.. first and second ends for pivotal movement within said support arm;

a first member fixed to said first end to engage a document positioned in said track between said first roller and said first member; and a second member rotatably mounted on said second end to engage said document positioned in said track between said second roller and said second member;

said support arm being shaped to limit the pivotal movement of said support member to a predetermined arc; and said pivotal movement of said support member being effective to enable said second member to cooperate with said second roller to move said document towards said bottom when said document is moved in first and second opposed directions within said document track.

13. The toggle mechanism as claimed in claim 12 in which said first roller provides a low friction drive and said second roller provides a high friction drive.

14. The toggle mechanism as claimed in claim 13 in which said support member provides a high friction surface to engage said document, and said second member provides a low friction surface to engage said document.

15. A document processing machine comprising:

a document track having a bottom;

a first roller rotatably mounted on a shaft positioned adjacent to said track, and a second roller fixed to said shaft to rotate therewith;

drive means for rotating said shaft and said second roller in first and second directions;

a support arm;

a rod having first and second ends, with said rod being pivotally supported between said first and second ends for pivotal movement within said support arm;

a first member fixed to said first end to cooperate with said first roller to pivot said rod in a first direction when said shaft and said second roller are rotated in said first direction;

a second member cooperating with said second roller to move a document therebetween in a first direction and towards said bottom when said shaft and said second roller are rotated in said first direction, and also to move said document in a second direction in said track and towards said bottom when said shaft and said second roller are rotated in said second direction; and document processing means positioned along said document track to process a document moved in said document track.

16. The document processing machine as claimed in claim 15 in which said first roller is a low friction roller, and said second roller is a high friction roller.

17. The document processing machine as claimed in claim 16 in which said first member is a high friction arcuately shaped member, and said second member is a low friction roller.

* * * * *

UNITED STATES PATENT AND TRADEMARK OFFICE

CERTIFICATE OF CORRECTION

PATENT NO. : 5,074,546

DATED : Dec. 24, 1991

INVENTOR(S) : Hanna et al.

It is certified that error appears in the above-identified patent and that said Letters Patent is hereby corrected as shown below:

Column 6, line 29, "7" should be --6--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*